US005727635A

United States Patent [19]

Doty et al.

[11] Patent Number: 5,727,635

[45] Date of Patent: Mar. 17, 1998

[54] VEHICULAR AND MARINE FIRE SUPPRESSION SYSTEM

[76] Inventors: Michael E. Doty, 8664 Eagle Pointe Dr., Knoxville, Tenn. 37931; Samuel D. McLane, Jr., 130 Pembroke Rd., Oak Ridge, Tenn. 37830

[21] Appl. No.: 572,160

[22] Filed: Dec. 13, 1995

[51] Int. Cl.[6] ..... A62C 3/07

[52] U.S. Cl. ..... 169/62; 169/74; 169/85

[58] Field of Search ..... 169/62, 74, 85

[56] References Cited

U.S. PATENT DOCUMENTS

| | | | |
|---|---|---|---|
| 1,980,051 | 11/1934 | Graham et al. | 169/85 |
| 2,311,845 | 2/1943 | Lindsay | 169/31 |
| 2,621,746 | 12/1952 | Beauregard | 169/31 |
| 2,630,942 | 3/1953 | Shaffer | 222/80.5 |
| 2,708,482 | 5/1955 | Nurkiewicz | 169/31 |
| 3,149,677 | 9/1964 | Blair | 169/85 |
| 3,255,824 | 6/1966 | Rodgers | 169/85 |
| 3,754,602 | 8/1973 | Magdars | 169/2 A |
| 3,889,752 | 6/1975 | Dunn | 169/59 |
| 3,972,373 | 8/1976 | Nichols et al. | 169/62 |
| 4,423,784 | 1/1984 | Bolen | 169/62 |
| 4,811,796 | 3/1989 | Allen | 169/62 |
| 4,982,798 | 1/1991 | Wang | 169/62 |
| 4,986,365 | 1/1991 | Shieh | 169/60 |
| 5,119,878 | 6/1992 | Lee | 169/62 |

FOREIGN PATENT DOCUMENTS

| | | | |
|---|---|---|---|
| 407672 | 3/1910 | France | 169/85 |
| 12459 | 9/1910 | France | 169/85 |
| 764028 | 5/1934 | France | 169/85 |
| 87408 | 2/1958 | Netherlands | 169/85 |
| 1147006 | 4/1969 | United Kingdom | 169/85 |

*Primary Examiner*—Gary C. Hoge
*Attorney, Agent, or Firm*—Pitts & Brittian, P.C.

[57] ABSTRACT

A vehicular and marine fire suppression system (10) for suppressing and quenching fires. The vehicular and marine fire suppression system (10) including a first canister (12), a second canister (20) and an actuating mechanism (26). The first canister (12) includes an inlet (14), an outlet (16) defining a neck (18) and a discharge mechanism (42) received within the neck (18). The first canister (12) houses a fire suppressing agent. The second canister (20) includes an outlet (22) and a seal (24) disposed about the outlet (22). The second canister (20) houses an agitating and pressurizing agent. The actuation mechanism (26) includes an actuating valve stem (36) received within the inlet (14) of the first cylinder (12). The valve stem (36) includes at least one opening (38) such that when the actuating mechanism (26) establishes a fluid communication between the first canister (12) and the second canister (20) the at least one opening (38) enhances the draw of the agitating and pressurizing agent through the valve stem (36) and the agitation and pressurization of fire suppressing agent such that a rupture disc (46) within the discharge mechanism (42) is ruptured and the entire contents of the fire suppressing agent are expelled through the discharge mechanism (16) to quench the fire.

13 Claims, 4 Drawing Sheets

VEHICULAR AND MARINE FIRE SUPPRESSION SYSTEM

TECHNICAL FIELD

This invention relates to the field of fire suppression systems. More particularly, this invention relates to fire suppression systems that suppress fires originating in vehicular and marine systems.

BACKGROUND ART

In the fields of vehicular and marine fire suppression, it is well known that effectiveness and efficiency of operation are critical factors in containing and quenching a fire. The importance of such factors is enhanced when considering fires within marine and automotive racing compartments, for example, where escape from an engulfed vehicle is typically unlikely or where there is the potential for a wider scope of injury such as in a marina or a multi-car collision.

Other devices have been produced to suppress vehicular and marine fires. Typical of the art are those devices disclosed in the following U.S. Patents:

| Pat. No. | Inventor(s) | Issue Date |
|---|---|---|
| 2,311,845 | C. H. Lindsay | Feb 23, 1943 |
| 2,621,746 | T. Beauregard | Jun 05, 1950 |
| 2,630,942 | J. E. Shaffer | Mar 10, 1953 |
| 2,708,482 | I. Nurkiewicz | May 17, 1955 |
| 3,754,602 | J. T. Magdars | Aug 28, 1973 |
| 3,889,752 | B. G. Dunn | Jun 17, 1975 |
| 3,972,373 | K. B. Nichols, et al. | Aug 03, 1976 |
| 4,423,784 | R. A. Bolen | Jan 03, 1984 |
| 4,811,796 | S. D. Allen | Mar 14, 1989 |
| 4,986,365 | K. C. Shieh | Jan 22, 1991 |
| 4,982,798 | H. F. Wang | Jan 08, 1991 |
| 5,119,878 | R. M. Lee | Jun 09, 1992 |

The '845 patent issued to Lindsay discloses a carbon dioxide discharge system which predicates operation upon postponement of outflow until substantially all of the contents of the flask have been vaporized.

The '482 patent issued to Nurkiewicz discloses a tank fire extinguisher having a flexible siphon tube component slidably mounted to a rigid bar such that the tube component slides along the bar according to the effect of gravity to insure complete contents discharge.

The '746 patent issued to Beauregard discloses a fire extinguisher having a nozzle which operates as a two-way valve permitting air pressure to be fed into and extinguishing fluid to be emitted from the unit. The device of the '746 patent requires liquid insertion from the bottom and air pressure insertion from the top.

The '942 patent issued to Shaffer discloses a home rechargeable, multi-purpose bomb which is adaptable as a fire-fighting device. The device of the '942 patent requires disposal of a pressurizing agent within the bomb precedent to its activation. Its multi-use adaptability likely results in contamination of bomb contents and renders it less effective as a fire-fighting device. Like the '746 device, the '942 device also requires pre-actuation utilization of a pressurizing cartridge.

The '602 patent issued to Magdars discloses a fire extinguishing system for boat engine compartments.

The '752 patent issued to Dunn discloses a engine compartment fire extinguishing system for motor vehicles which utilizes a powder foam extinguishing agent to "fog" an involved engine compartment.

The '373 patent issued to Nichols, et al., and the '798 patent issued to Wang disclose vehicle fire extinguishing systems whereby a conventional fire extinguisher is attached to perforated tubing system disposed about an engine compartment to disperse an extinguishing agent within the compartment and extinguish a compartment fire.

The '784 patent issued to Bolen, the '365 patent issued to Shieh, and the '878 patent issued to Lee each disclose a fire extinguishing system which utilizes a fire extinguisher that may be activated manually, by the inertial force or extreme temperature to extinguish a vehicle fire.

The '796 patent issued to Allen discloses a fire fighting apparatus whereby a hose may be attached to a water filled tubeless tire to extinguish a fire.

None of these patents discloses a fire extinguishing system which utilizes a fire suppressant that cools and smothers fires while minimizing flashback. None of these devices includes unique designs for an actuator valve stem and a discharge mechanism which enable the fire suppression system to expel 100% of its contents regardless of the attitude of the vehicle. None of these devices are easily adapted for electrical, pneumatic, heat or manual activation, depending on the intended use and scope of protection. Further, none of these patents disclose a fire extinguishing system which is easy to discharge and economically recharged.

Therefore, it is an object of this invention to provide a fire suppression system which is adaptable to diverse types of vehicles and the particular demands of those vehicles.

Another object of this invention is to provide a fire suppression system which readily detects and automatically suppresses fires in vehicles.

A further object of this invention is to provide a fire extinguishing system which is easily disposed in hard to reach areas for direct suppression action in the event of fire.

Still another object of this invention is to provide a fire suppression system which is economical and easily deployed.

Further, it is an object of this invention to provide a fire suppression system that may be actively or passively activated.

It is another object of this invention to provide a fire suppression system which may be pneumatically, electrically, manually or thermally activated.

It is also an object of this invention to provide a fire suppression system which utilizes an aqueous film forming foam, AFFF, which suppresses fires by cooling and smothering the flames thereby eliminating flashback.

Yet another object of the present invention is to provide a fire suppression system which expels 100% of its contents regardless of vehicle attitude.

A further object of this invention is to provide a fire suppression system which is adaptable to systemic use involving multiple activation canisters, multiple activation sites and multiple fire suppressant cylinders.

DISCLOSURE OF THE INVENTION

Other objects and advantages will be accomplished by the present invention which serves to suppress and quench fires originating in vehicular and marine systems. The vehicular and marine fire suppression system of the present invention includes a first canister, a second canister and an actuating mechanism. The first canister includes an inlet and an outlet defining a neck. The first canister houses a fire suppressing agent. The second canister includes an outlet and a seal disposed about the outlet. The second canister houses an agitating agent. The dimensions of the second canister, as well as the quantity and pressure of the agitating agent disposed within that canister, will vary according to the volume of the first canister, the density of the fill, and the expected temperature in which the fire suppression system will be disposed to insure maximal effectiveness of charging and discharge of the fire suppression system.

The actuating mechanism establishes a fluid communication between the first and second canisters of the vehicular fire suppression system. The actuation mechanism includes an actuating valve stem received within the inlet of the first cylinder. The valve stem includes at least one opening such that when fluid communication and pressurization is established between the first and second canisters, the opening of the valve stem enhances the draw of the agitating and pressurizing agent through the valve stem and the agitation and pressurization of the fire suppressing agent thereby expelling the entire contents of the fire suppressing agent through the outlet to quench the fire.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
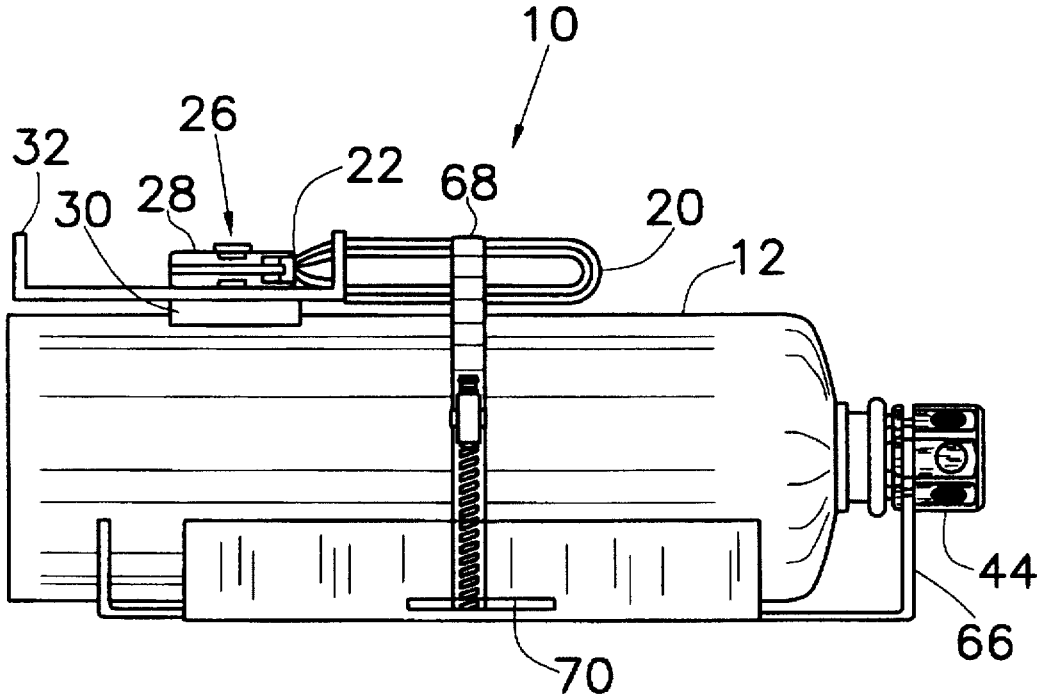
FIG. 1 is an elevation view of the vehicular and marine fire suppression system constructed in accordance with several features of the present invention.

A vehicular and marine fire suppression system incorporating various features of the present invention is illustrated generally at 10 in the figures. The vehicular and marine fire suppression system 10 is designed to suppress and quench fires originating in vehicular systems such as in automobiles, trucks, boats and other vehicles. Moreover, in the preferred embodiment, the vehicular and marine fire suppression system 10 is designed to expel 100% of its contents to cool and smother a fire while eliminating the risk of flashback.

The vehicular and marine fire suppression system 10 comprises a first canister 12 having an inlet 14 and an outlet 16 defining a neck 18. The first canister 12 houses a fire suppressing agent. In the preferred embodiment, the first canister 12 is fabricated from aluminum, straight steel or stainless steel, depending upon customer need and intended use. The preferred embodiment of a straight steel canister further includes an epoxy tar coating to inhibit rust formation within the canister. Regardless of the structural material selected, the exterior of the first canister 12 may be coated as desired.

The fire suppressing agent of the preferred embodiment is AFFF (aqueous film forming foam), a UL listed and USCG approved fire extinguishing agent which suppresses a fire by cooling and smothering it, thereby eliminating the possibility of flashback. AFFF is a preferred fire suppressant as it is lighter than water and covers fuel to prevent re-ignition. Those skilled in the art will recognize that other approved fire suppressing agents, such as Halon, may be employed with equal effectiveness in the vehicular and marine fire suppression system 10, as well.

The vehicular and marine fire suppression system 10 further comprises a second canister 20 having an outlet 22 and a seal 24 disposed about the outlet 22. The second canister 20 houses an agitating and pressurizing agent. Carbon dioxide is the agitating and pressurizing agent of the preferred embodiment. The dimensions of the second canister 20 are proportionate to the volume of the first canister 12 to insure maximal effectiveness of charging and discharge. Similarly, the quantity and pressure of the carbon dioxide within the second canister 20 will vary with the density of the fill, the dimensions of the second canister 20 and the expected temperature in which the vehicular and marine fire suppression system 10 will be disposed.

An actuating mechanism 26 establishes a fluid communication between the first canister 12 and the second canister 20 of the fire suppression system 10. The actuation mechanism 26 includes an actuator 28, an actuator base 30, a restraint bracket 32, an actuating means 34 and an actuating valve stem 36 having at least one slotted opening 38. The valve stem 36 is received within the inlet 14 of the first cylinder 12. The actuator base 30 is disposed about the valve stem 36 and is secured to the first cylinder 12. The restraint bracket 32 is similarly disposed about the valve stem 36 and is secured to the actuator base 30. The restraint bracket 32 carries the actuating means 34 for initiating operation of the actuation mechanism 26 and the vehicular and marine fire suppression system 10. The actuator 28 is seated on the restraint bracket 32 and functions to actuate the second cylinder 20. The opening 38 increases the volume of air entering the valve stem, thereby enhancing the draw of the agitating and pressurizing agent through the valve stem 36 and the agitation and pressurization of the fire suppressing agent.

In the preferred embodiment, the actuator 28 includes an actuating needle (not shown) which pierces the seal 24 on the second canister 20 to permit the efflux of the agitating agent. The actuator 28 of the preferred embodiment may further include a safety pin 40 to prevent unintended engagement of the actuator mechanism 26 and discharge of the fire suppression system 10. Such a safety measure is particularly important where the fire suppression system 10 is disposed, for example, in a vehicle that is transported such as a racing vehicle.

Figure 7:
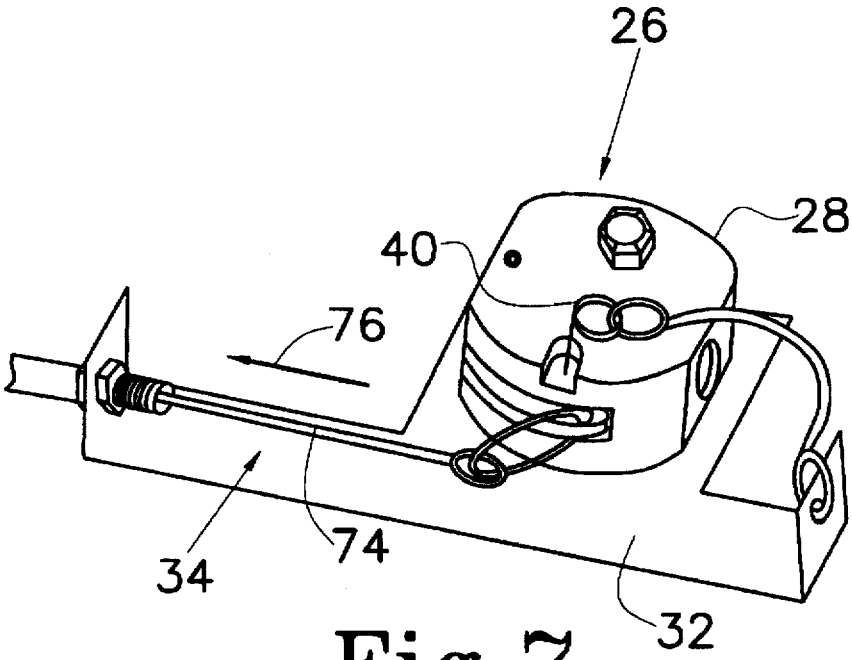
FIG. 7 is a perspective view of one embodiment of the actuation mechanism of the present invention in which the cable of the mechanism is pulled or retracted.
Figure 8:
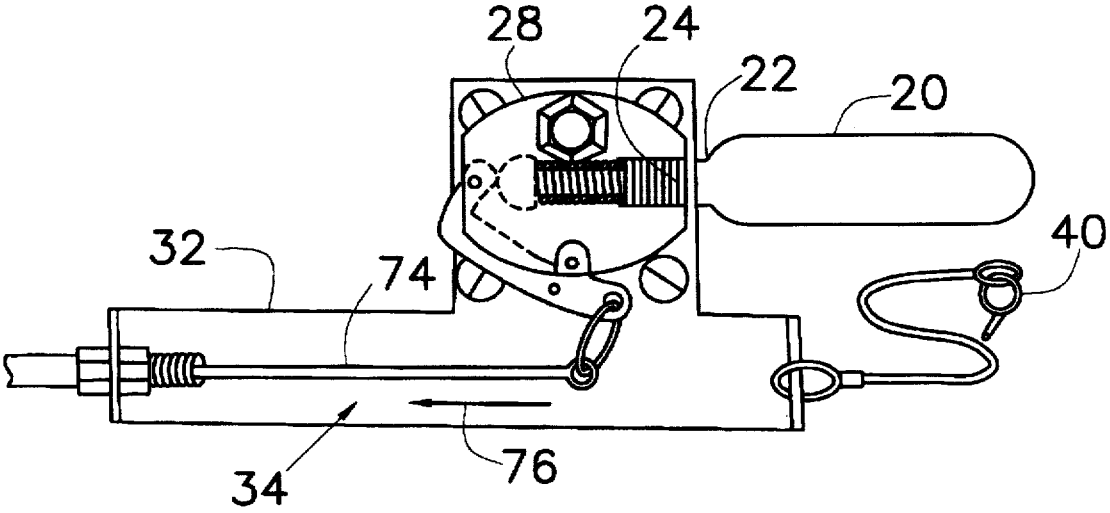
FIG. 8 illustrates a plan view of the actuation mechanism of the present invention illustrated in FIG. 7.
Figure 9:
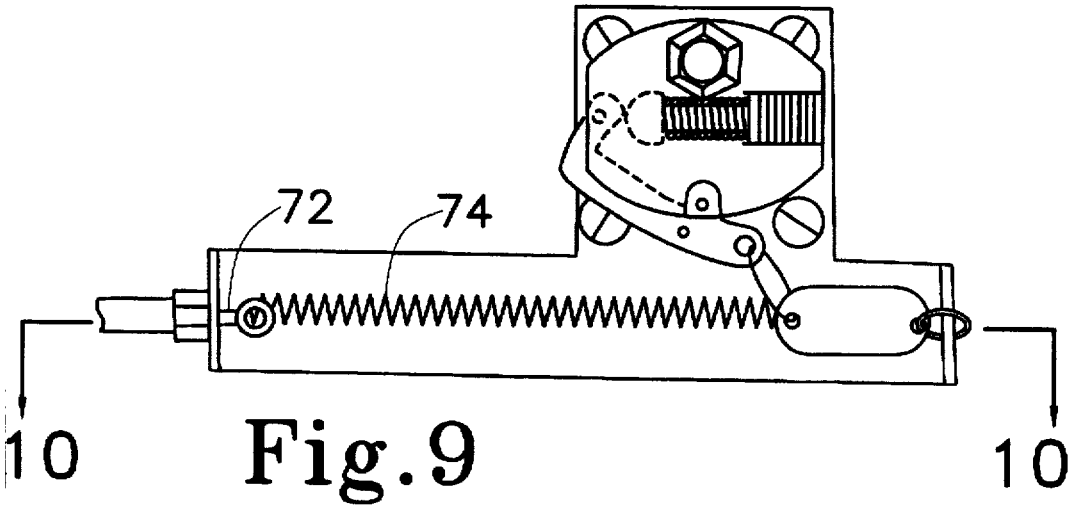
FIG. 9 is a plan view of an alternate embodiment of the actuation mechanism of the present invention.
Figure 10:
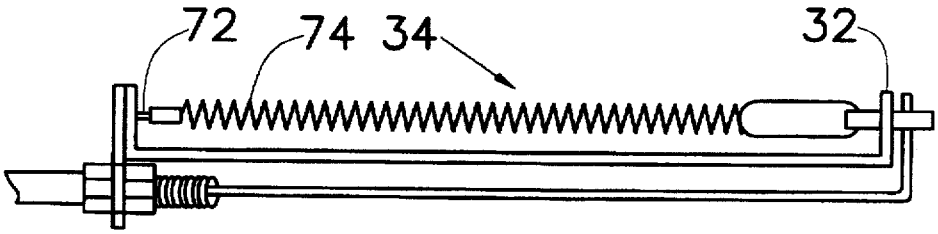
FIGS. 10, 10A, & 10B illustrate elevation views of three additional alternative embodiments of the actuation mechanism of the present invention.
Figure 10A:
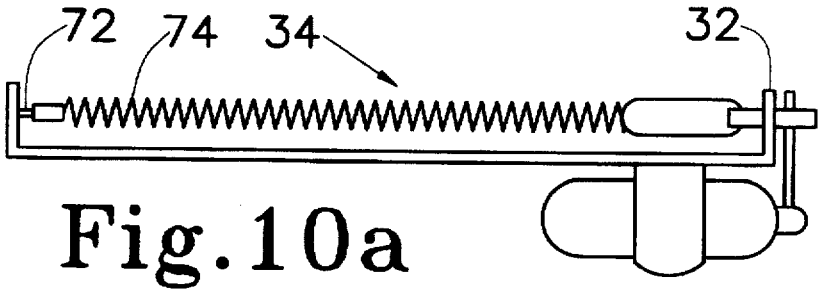
Figure 10B:
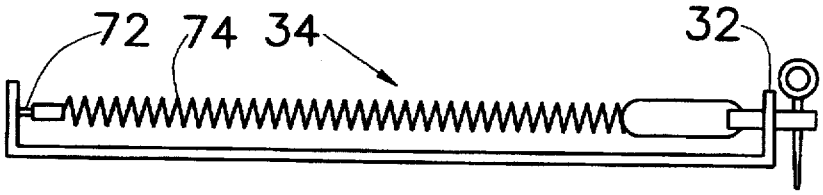

In the embodiment illustrated in FIGS. 7 and 8, the actuating means 34 includes a biasing member 72 and a cable 74 secured to the actuator 28 such that the actuator 28 is activated by removal of the pin 40 and pulling or retracting the cable 74. Arrow 76 illustrates the direction of travel of the cable in the pulling motion.

As FIGS. 9, 10, 10A & 10B exemplify, the actuating means 34 will vary with the intended use and location of the vehicular fire suppression system 10. Based on these exemplary illustrations, it is clear that the vehicle fire suppression system 10 of the present invention is capable of manual, electrical, pneumatic or thermal activation or of activation by any combination of these methods. The restraint bracket 32 of the preferred embodiment is configured according to the desired method of application.

Figure 2:
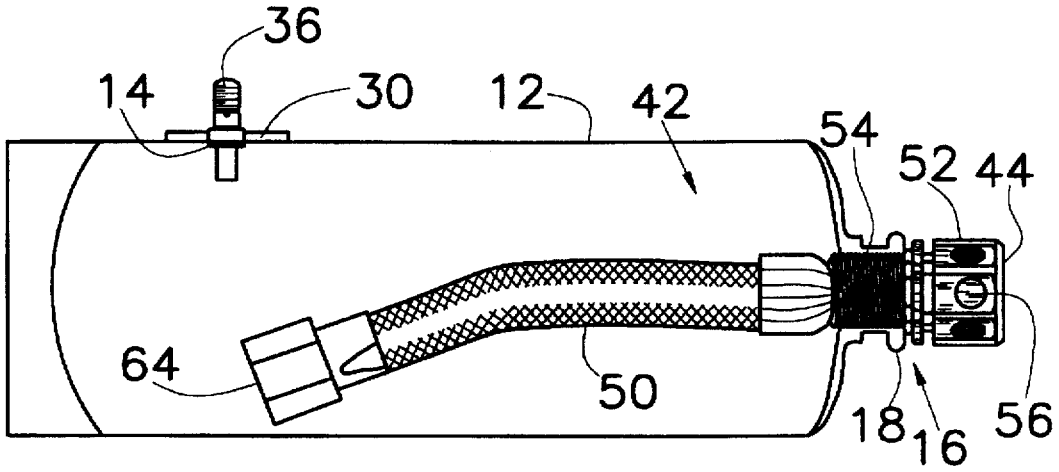
FIG. 2 illustrates an elevation view, in section, of the present invention.
Figure 3:
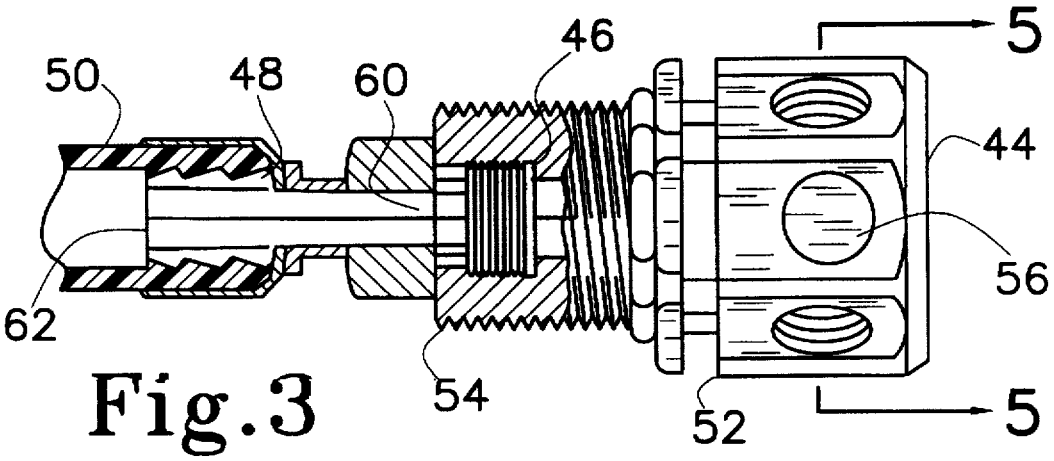
FIG. 3 is an elevation view, in section, of the discharge mechanism of the present invention.
Figure 4:
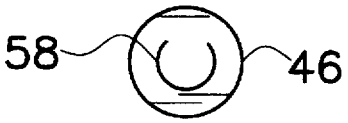
FIG. 4 illustrates a plan view of the non-fragmenting rupture disc of the present invention.
Figure 5:
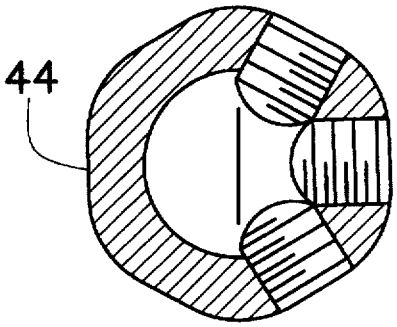
FIG. 5 is a plan view, in section of the discharge head of the discharge mechanism.
Figure 6:
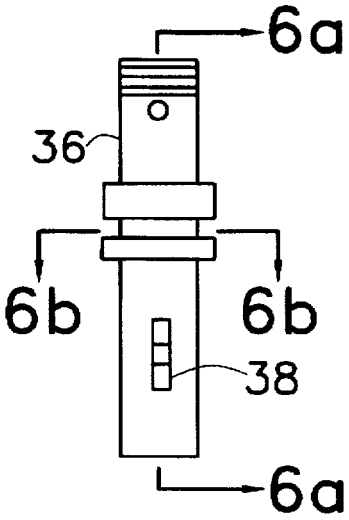
FIG. 6 illustrates an elevation view, of the actuating valve stem of the present invention.
Figure 6A:
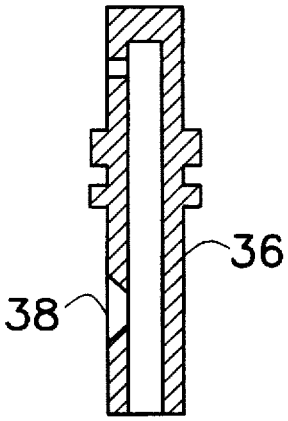
FIGS. 6A & 6B illustrate elevation and plan views, in section, of the actuating valve stem of the present invention, taken at 6A—6A and 6B—6B of FIG. 6, respectively.
Figure 6B:
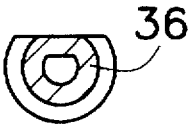

As illustrated in FIG. 2, the actuator valve stem 36 of the preferred embodiment is disposed within the inlet 14 of the first cylinder 12 up to a point equivalent to one half of the length of the valve stem 36 to maximize its effectiveness. In the preferred embodiment, the opening 38 in the actuator valve stem 36 is slotted. Further, the actuator valve stem 36 of the preferred embodiment contains a plurality of equally spaced slotted openings 38. Those skilled in the art will recognize that other opening configurations will enhance the uptake of the agitating and pressurizing agent through the valve stem 36 with equal effectiveness.

A discharge mechanism 42 is received within the neck 18 defined by the outlet 16 of the first canister 12. The discharge mechanism 42 disperses the fire suppressing agent to quench a fire. The discharge mechanism 42 includes a manifold 44, a rupture disc 46, a nozzle 48 and a liquid pick-up tube 50. The manifold 44 has a first end 52 and a second end 54 which is configured to be received within the neck 18 formed by the outlet 16 of the first canister 12. The first end 52 of the manifold 44 has at least one discharge opening 56. The rupture disc 46 is scored 58 to permit the opening of the rupture disc 46 without fragmentation resulting in an obstruction of that opening. The nozzle 48 includes a first end 60 and a second end 62. The first end 60 of the nozzle 48 is fitted over the rupture disc 46 within the second end 54 of the manifold 44. The liquid pick-up tube 50 is received on the second end 62 of the nozzle 48.

In the preferred embodiment, the first end 52 of the manifold 44 includes three discharge openings 56 to enhance the air turbulence within the first canister 12 and further induce the dispersing of the fire suppressing agent. The rupture disc 46 of the preferred embodiment is scored 58 three-quarters of a diameter to insure proper rupturing without opening obstruction. Moreover, the rupture disc 46 is fabricated to withstand changes in pressure up to 40 p.s.i. or any other pressure, as may be required, to preclude the possibility of spontaneous rupturing due to a change in altitude. The liquid pick-up tube 50 of the preferred embodiment is weighted at its end 64 to assist it in remaining at the lowest portion of the first cylinder 12 regardless of the position of the cylinder 12.

While a single system has been described, it should be recognized that the vehicular and marine fire suppression system 10 of the present invention is easily expanded to a system including multiple first canisters 12, multiple second canisters 20, multiple activation mechanisms 26 and multiple discharge mechanisms 42 depending on the size of compartment and the desired method of fire prevention. Further, it should be recognized that the vehicle fire suppression system 10 may be disposed for use with a securement bracket 66 as illustrated in FIG. 1 or without such a bracket 66 depending on space and related parameters. In the preferred embodiment, when a securement bracket 66 is employed, the system 10 is secured to the bracket 60 using a tie-wrap 68 which passes through openings 70 in the securement bracket 66 and encompasses both the first canister 12 and the second canister 20.

From the foregoing description, it will be recognized by those skilled in the art that a vehicular and marine fire suppression system 10 offering advantages over the prior art has been provided. Specifically, the vehicular and marine fire suppression system 10 provides a vehicular and marine fire suppression system 10 which utilizes a fire suppressant that cools and smothers fires while minimizing flashback. The vehicular and marine fire suppression system 10 employs unique designs to insure 100% expulsion of the fire suppressing agent. Such expulsion is possible regardless of the attitude of the vehicle. The vehicular and marine fire suppression system 10 is readily adapted for electrical, pneumatic, heat or manual activation as desired or permitted by environmental parameters. Further, the fire suppression system 10 of the present invention is rechargeable and economical to maintain. The fire suppression system 10 is adaptable to diverse types of vehicles and the particular demands of those vehicles. The system 10 readily detects and automatically suppresses vehicle fires. Further, the vehicular and marine fire suppression system 10 is easily disposed in hard to reach areas for direct suppression action in the event of fire. The fire suppression system 10 may be actively or passively activated. Further, the fire suppression system 10 is adaptable to systemic use involving multiple activation canisters 20, multiple activation sites and multiple fire suppressant cylinders 12.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A fire suppression system for extinguishing vehicular and marine fires, said fire suppression system for being removably disposed in a fixed location within a land or marine vehicle, said fire suppression system comprising:

a first canister containing a fire suppressing agent, said first canister having an inlet and an outlet defining a neck for receiving a discharge mechanism, said discharge mechanism including a manifold, a rupture disc, a nozzle and a liquid pick-up tube, said manifold having a first end and a second end dimensioned for being disposed within said outlet of said first cylinder, said first end of said manifold having at least one discharge opening, said second end of said manifold for receiving said rupture disc, said nozzle having a first end and a second end, said first end of said nozzle being fitted over said rupture disc within said second end of said manifold, said liquid pick-up tube being received on said second end of said nozzle;

a second canister containing an agitating and pressurizing agent, said second canister having an outlet and a seal disposed about said outlet; and an actuating mechanism for establishing a fluid communication between said first and said second canisters, said actuating mechanism having an actuating valve stem received within said inlet of said first canister, said valve stem having at least one opening such that when fluid communication is established between said canisters, said opening on said valve stem draws said agitating and pressurizing agent through said valve stem and into said first canister to agitate and pressurize said fire suppressing agent such that essentially all of said fire suppressing agent is forced through said outlet of said first canister to quench a fire.

2. The vehicular and marine fire suppression system of claim 1 wherein said liquid pick-up tube is weighted.

3. The vehicular and marine fire suppression system of claim 1 wherein said rupture disc is scored to permit the obstruction-free opening of said rupture disc without fragmenting.

4. The vehicular and marine fire suppression system of claim 1 wherein said rupture disc is rupture resistant up to 40 lb. p.s.i.

5. A fire suppression system for extinguishing vehicular and marine fires, said fire suppression system for being removably disposed in a fixed location within a land or marine vehicle, said fire suppression system comprising:

a first canister containing a fire suppressing agent, said first canister having an inlet and an outlet;

a second canister containing an agitating and pressurizing agent, said second canister having an outlet and a seal disposed about said outlet;

an actuating mechanism for activating said agitating and pressurizing agent of said second canister and providing fluid communication between said first and second canisters; and a discharge mechanism for dispersing said suppressing agent, said discharge mechanism being received within said outlet of said first canister, said discharge mechanism including a manifold, a non-fragmenting rupture disc received within a second end of said manifold, a nozzle having a first end and a second end, said first end of said nozzle being fitted over said rupture disc within said second end of said manifold and a liquid pick-up tube, said liquid pick-up tube being received on said second end of said nozzle such that the combination of said agitating and pressurizing agent and said suppressing agent in said first canister creates sufficient force to rupture said rupture disc and forcibly expel said suppressing agent from said manifold when said actuating mechanism establishes fluid communication between said first and second canisters.

6. The vehicular and marine fire suppression system of claim 5 wherein said manifold further includes at least one discharge opening.

7. The vehicular and marine fire suppression system of claim 5 wherein said rupture disc is rupture resistant up to 40 lb. p.s.i.

8. The vehicular and marine fire suppression system of claim 5 wherein said liquid pick-up tube is weighted.

9. A fire suppression system for extinguishing vehicular and marine fires, said fire suppression system for being removably disposed in a fixed location within a land or marine vehicle, said fire suppression system comprising:

a first canister containing a fire suppressing agent, said first canister having an inlet and an outlet, said outlet defining a neck;

a second canister containing an agitating and pressurizing agent, said second canister having an outlet and a seal disposed about said outlet;

an actuating mechanism for establishing a fluid communication between said first and said second canisters, said actuating mechanism having an actuating valve stem received within said inlet of said first canister, said valve stem having at least one slotted opening such that when fluid communication is established between said canisters, said slotted opening on said valve stem enhancing the draw of said agitating and pressurizing agent through said valve stem and the agitation and pressurization of said fire suppressing agent, an actuator for seating and activating said second canister, an actuator base for disposing said actuator about said valve stem on said first canister, a restraint bracket for securing an actuator to said actuator base and an actuating means adaptably fitted to said restraint bracket; and a discharge mechanism for dispersing said fire suppressing agent to quench a fire, said discharge mechanism being disposed within said neck defined by said outlet of said first canister, said discharge mechanism including a manifold, a rupture disc, a nozzle and a weighted liquid pick-up tube, said manifold having a first end and a second end dimensioned for being disposed within said outlet of said first canister, said first end of said manifold having at least one discharge opening, said second end of said manifold for receiving said rupture disc, said rupture disc being scored to permit the obstruction-free opening of said rupture disc without fragmenting, said nozzle having a first end and a second end, said first end of said nozzle being fitted over said rupture disc within said second end of said manifold, said liquid pick-up tube being received on said second end of said nozzle.

10. A fire suppression system for extinguishing vehicular and marine fires, said fire suppression system for being removably disposed in a fixed location within a land or marine vehicle, said fire suppression system comprising:

a first canister containing a fire suppressing agent, said first canister having an inlet and an outlet;

a second canister containing an agitating and pressurizing agent, said second canister having an outlet and a seal disposed about said outlet; and an actuating mechanism for establishing a fluid communication between said first and said second canisters, said actuating mechanism having an actuating valve stem received within said inlet of said first canister, an actuator for seating and activating said second cylinder, an actuator base for disposing said actuator about said valve stem on said first cylinder, a restraint bracket for securing an actuator to said actuator base and an actuating means adaptably fitted to said restraint bracket, said valve stem having at least one slotted opening such that when fluid communication is established between said canisters, said opening on said valve stem enhances the draw of said agitating and pressurizing agent through said valve stem and the agitation and pressurization of said fire suppressing agent thereby forcing said fire suppressing agent through said outlet to quench a fire.

11. The vehicular and marine fire suppression system of claim 10 wherein said actuator further includes a pin to preclude inadvertent activation of said actuator mechanism during installation and maintenance and said actuating means is a biasing member and a cable secured to said actuator such that said actuator is activated by removal of said pin after installation and maintenance and manually pulling said cable.

12. A fire suppression system for extinguishing vehicular and marine fires, said fire suppression system for being removably disposed in a fixed location within a land or marine vehicle, said fire suppression system comprising:

a first canister containing a fire suppressing agent, said first canister having an inlet and an outlet;

a second canister containing an agitating and pressurizing agent, said second canister having an outlet and a seal disposed about said outlet;

an actuating mechanism for activating said agitating and pressurizing agent of said second canister and providing fluid communication between said first and second canisters, said actuating mechanism having an actuator for seating and activating said second cylinder, an actuator valve stem received within said inlet of said first canister, an actuator base for disposing said actuator about said valve stem on said first canister, a restraint bracket for securing an actuator to said actuator base, and an actuating means adaptably fitted to said restraint bracket, said valve stem having at least one opening such that when fluid communication is established between said canisters, said opening on said valve stem being slotted to enhance the draw of said agitating and pressurizing agent through said valve stem and the agitation and pressurization of said fire suppressing agent thereby forcing said fire suppressing agent through said outlet to quench a fire; and a discharge mechanism for dispersing said suppressing agent, said discharge mechanism being received within said outlet of said first canister, said discharge mechanism including a manifold and a non-fragmenting rupture disc received within a second end of said manifold such that, when said actuating mechanism establishes fluid communication between said first and second canisters, the combination of said agitating and pressurizing agent and said suppressing agent in said first canister creates sufficient force to rupture said rupture disc and forcibly expel said suppressing agent from said manifold.

13. The vehicular and marine fire suppression system of claim 12 wherein said actuator further includes a pin to preclude inadvertent activation of said actuator mechanism during installation and maintenance and said actuating means is a biasing member and a cable secured to said actuator such that said actuator is activated by removal of said pin after installation and maintenance and manually pulling said cable.

* * * * *